United States Patent [19]

Umeda et al.

[11] Patent Number: 4,520,354

[45] Date of Patent: May 28, 1985

[54] DISPLAY DEVICE FOR COPYING APPARATUS

[75] Inventors: Tadashi Umeda; Hideo Miyoshi; Keiichi Kishimoto; Kazumi Iida; Kazunori Akiyama; Yuji Abe; Masato Taniguchi, all of Osaka, Japan

[73] Assignee: Mita Industrial Company Limited, Osaka, Japan

[21] Appl. No.: 393,872

[22] Filed: Jun. 30, 1982

[30] Foreign Application Priority Data

Jun. 30, 1981 [JP] Japan ..... 56-102943

[51] Int. Cl.[3] ..... G08B 21/00

[52] U.S. Cl. ..... 340/679; 340/691

[58] Field of Search ..... 340/691, 679

[56] References Cited

U.S. PATENT DOCUMENTS

| | | | |
|---|---|---|---|
| 3,999,176 | 12/1976 | Kellogg et al. | 340/691 X |
| 4,019,120 | 4/1977 | Fattic | 340/691 X |
| 4,390,872 | 6/1983 | Murakami et al. | 340/691 X |
| 4,424,458 | 1/1984 | Buck et al. | 340/691 X |

*Primary Examiner*—Glen R. Swann, III

*Attorney, Agent, or Firm*—Wenderoth, Lind & Ponack

[57] ABSTRACT

A display for a copying apparatus includes a display element for indicating the operating conditions of the copying apparatus. The display has a number of detectors for detecting each of a group of operating conditions and an energizer for energizing the display element in response to the outputs from the detectors. The display element operates with a predetermined on-period and a predetermined off-period for each corresponding detector. The display is capable of displaying a group of operating conditions by a single display element through a group of display conditions such as being on, being off and blinking.

2 Claims, 7 Drawing Figures

DISPLAY DEVICE FOR COPYING APPARATUS

BACKGROUND OF THE INVENTION

1. Field of the Invention

The present invention relates to a display device for displaying the operation conditions of a copying apparatus.

2. Description of the Prior Art

In a prior art apparatus, unusual driving conditions of a copying apparatus such as a shortage of developing material or copy paper jamming are recognized by turning on a display lamp. In the prior art, the display lamp is off when the copying apparatus operates in the usual condition, and is on, namely is kept on when the copying apparatus is in an unusual driving conditions. In an electrostatic copying apparatus, it would be more convenient for users if the copying apparatus is capable of displaying various kinds of operating conditions. In the prior art, since a display lamp is provided for displaying a single operating condition, a wide space is required for a plurality of display lamps, and the circuit for driving the display lamps is complicated.

The object of the invention is to solve the foregoing technical problems and to provide a display device for a copying apparatus whose circuit is simple, and which occupies a small space.

SUMMARY OF THE INVENTION

To accomplish the foregoing objectives, there is provided a display device having a display element which turns on to display an operating condition of a copying apparatus. The display device comprises a plurality of detecting means for detecting each of a plurality of operating conditions, and an energizing means which operates in response to the outputs from the detecting means for energizing the display element with a predetermined on-period and off-periods, each of said predetermined periods corresponding to each detecting means.

According to the invention, since a single display element is capable of displaying a plurality of operating conditions through the use of three display conditions, i.e.-to turn-on, to turn-off, and to blink, the drive circuit for the display device is simple and also, the space occupied by the display element in the display panel is small.

The detecting means mentioned above generates a high level output signal corresponding to a predetermined operating condition and a low level signal corresponding to another predetermined operating condition. In addition, the means for energizing the display element comprises an OR gate for receiving an output signal from a detecting means, a driving means which operates response to an output signal from the OR gate for driving the display element, an AND gate which operates in response to an output signal from another detecting means for providing an output signal to the OR gate, and an astable circuit for providing an output signal to the AND gate.

The means for energizing the display element generates a high level output signal corresponding to an operating condition detected by a detecting means and a low level signal corresponding to another operating condition detected by another detecting means. Furthermore, the means for energizing the display element comprises an astable circuit for generating a pulse output having a duty cycle which is not equal to 50 percent, an AND gate which operates in response to an output signal from a detecting means and the pulse output from the astable circuit for providing an output signal comprising pulses whose on period corresponds to one of either the on-period or the off-period and whose off period corresponds to the other of either the on-period or off-period, a logic circuit which operates in response to an output signal from another detecting means and the pulse output from the astable circuit for providing an output signal having pulse retaining period corresponding to the same period as the pulse period in the AND gate and pulse period corresponding to the same period as the pulse period in the AND gate, an OR gate which operates in response to the output signal from the AND gate and the output signal from the logic circuit, and a driving means which operates in response to the OR gate for driving the display element.

The means for energizing the display element comprises a detecting switch for energizing the astable circuit, and which operates when an operating condition should be inspected. Accordingly, it is possible to selectively display the usually necessary operating condition of a copying apparatus, or the occasionally necessary operating condition thereof.

The detecting switch may be pushed by operating means having a tip portion. Therefore, the detecting switch is pushed when it is necessary and is not pushed accidentally.

DETAILED DESCRIPTION OF THE INVENTION

The present invention relates to a display device for displaying a driving condition of a copying apparatus.

Figure 1:
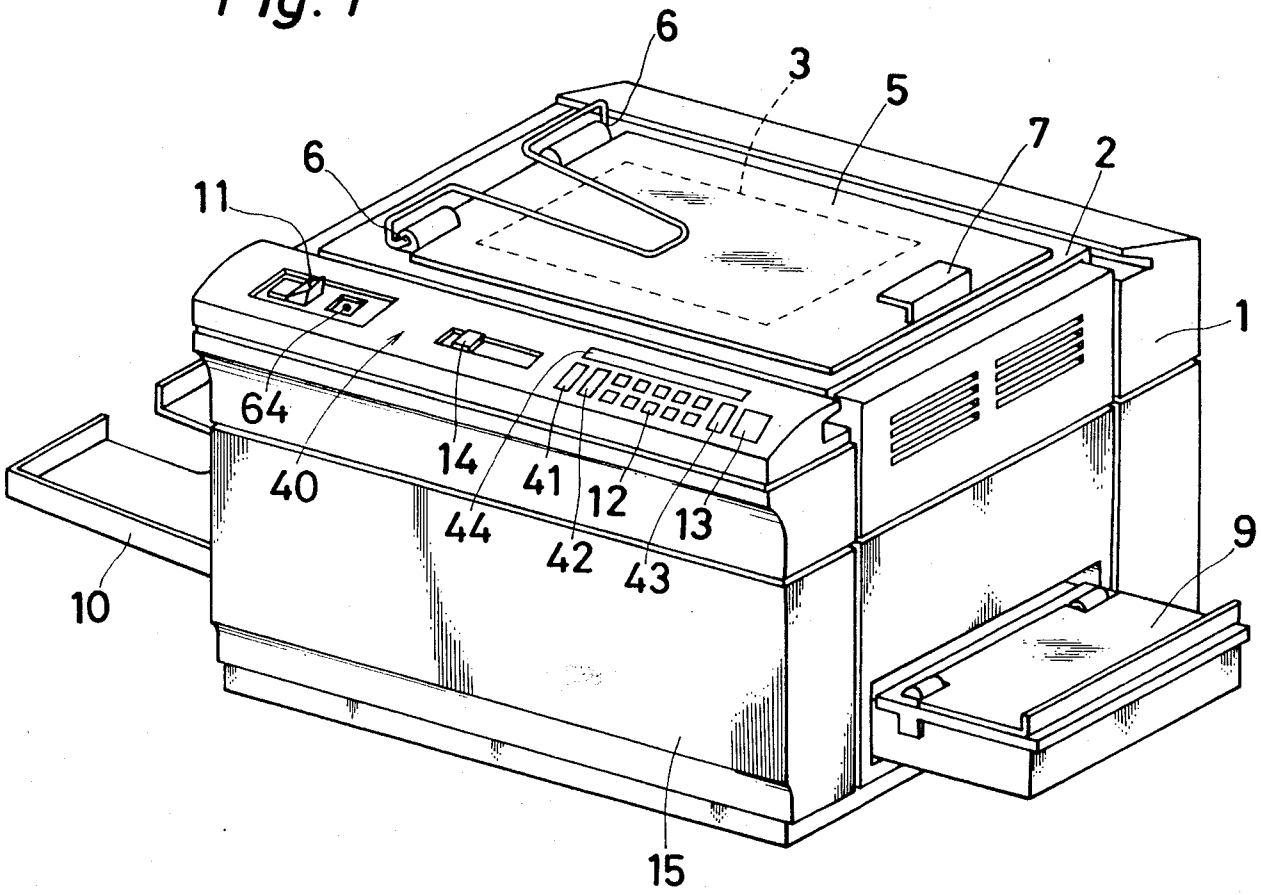
FIG. 1 is an overall perspective view of a copying apparatus according to a preferred embodiment of the present invention.
Figure 2:
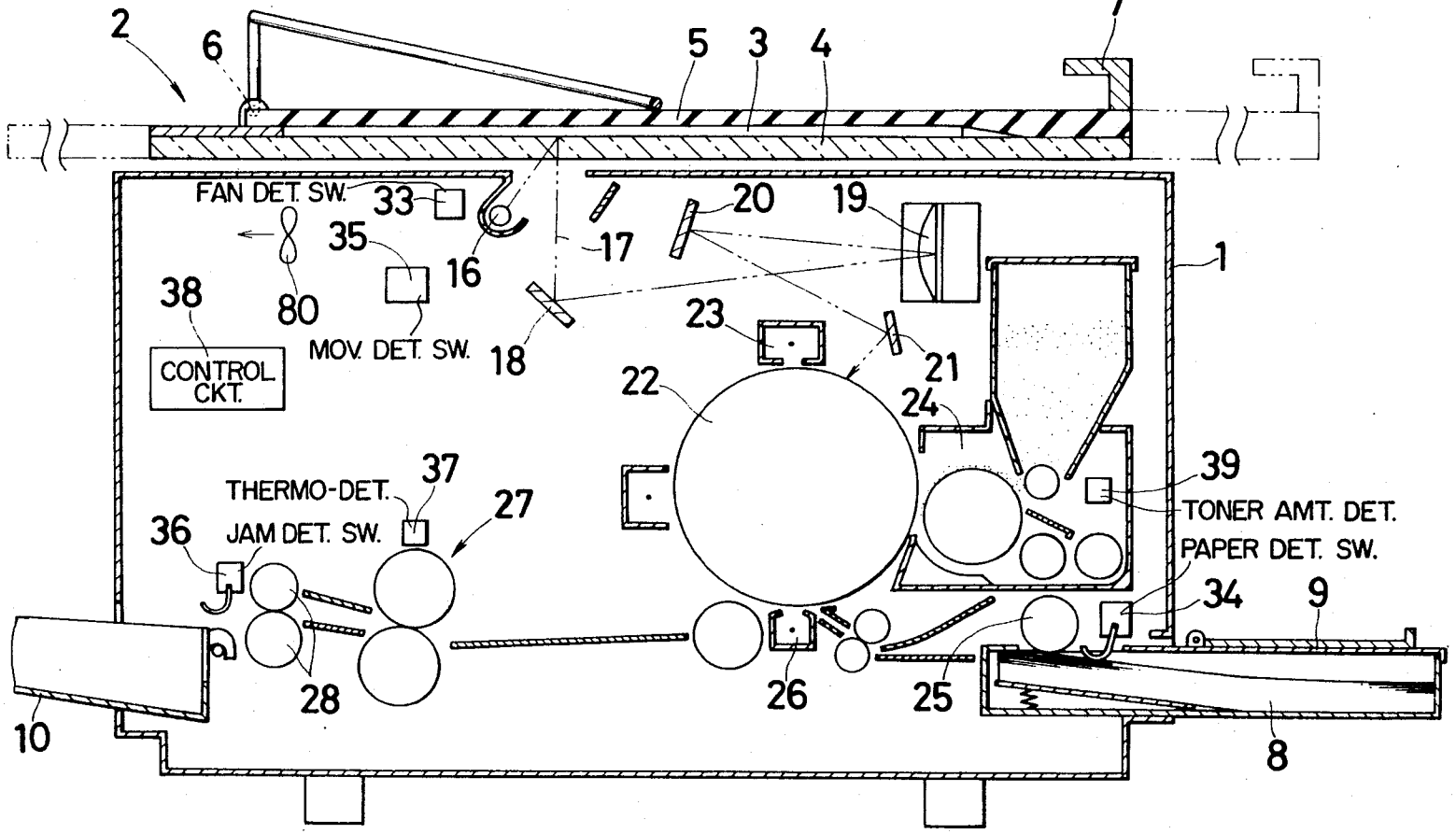
FIG. 2 is a simplified longitudinal sectional view of FIG. 1.

FIG. 1 is an overall perspective view of a copying apparatus embodying the present invention, and FIG. 2 is a simplified longitudinal sectional view of FIG. 1. At an upper portion of a housing 1 of an electrostatic copying apparatus, an original document table 2 is provided movably in a horizontal direction, in a lateral direction of FIG. 2. The original document table 2 has a transparent plate 4 on which an original document 3 to be copied is placed. The original document 3 placed on the original document table 2 is covered with an original document cover 5 which is rotatably supported along a rotary shaft 6 having an axis parallel to the transparent plate 4. At a free end of the original document cover 5, there is provided a handle 7 for opening and closing the original document cover 5. The original document cover 5 is larger in dimensions than the largest original document 3 to be copied. The housing 1 is provided with a cassette 9 having copy paper sheet 8 at a side portion (rightward in FIG. 2), and a fixed copy paper sheet is fed out on a tray 10 mounted at a left side portion of the housing 1 in FIG. 2. The housing 1 is capable of being opened by pulling a front panel 15 over the paper of FIG. 2 when the copying apparatus is repaired.

In the housing 1, light from an exposure lamp 16 fixed under the transparent plate 4 passes through the transparent plate 4, is reflected by the original document 3, and then reaches an outer surface of a photosensitive drum 22 through a mirror 18, mirror lens 19 and mirrors 20 and 21 as shown by a dotted line 17 to form an image of the original document. An electrostatic latent image of the original document is formed on the photosensitive drum 22 which has been charged by an exposure charging device. The electrostatic latent image is changed into a visible toner image by a developing device 24. The copy paper sheets 8 in the cassette 9 are fed one by one by a feed roller 25, and the toner image on the photosensitive drum 22 is transferred on the copy paper sheet 8 by a transfer charging device 26. The transferred copy paper sheet is fixed by a heat fixing device 27 and fed out on the tray 10 by discharge rollers 28.

In the housing 1, there is provided a detecting switch 34 above the cassette 9 in order to detect the copy paper sheets 8 in the cassette 9. At an upper portion in the housing 1, there is provided a detecting switch 35 for detecting reciprocating movement of the original document table 2. In the vicinity of the discharge rollers 28, there is provided a detecting switch 36 for detecting a jamming of copy paper sheets 8. In the vicinity of the heat fixing device 27, there is provided a thermo-detector 37 for detecting that the temperature of the heat fixing device 27 has reached a suitable temperature for fixing after a power switch 11 has been turned on. For example, in the developing device 24, a dual component developing material including carrier and toner is stored, and there is provided a toner amount detecting device 39 for detecting the amount of toner being consumed over a predetermined level at a downward portion in the developing device 24. In the vicinity of the exposure lamp 16, there is provided a detecting switch 33 for detecting that a fan 80 for cooling the exposure lamp 16 has stopped by detecting an increased temperature of the exposure lamp 16 which is higher than a predetermined level.

Figure 3:
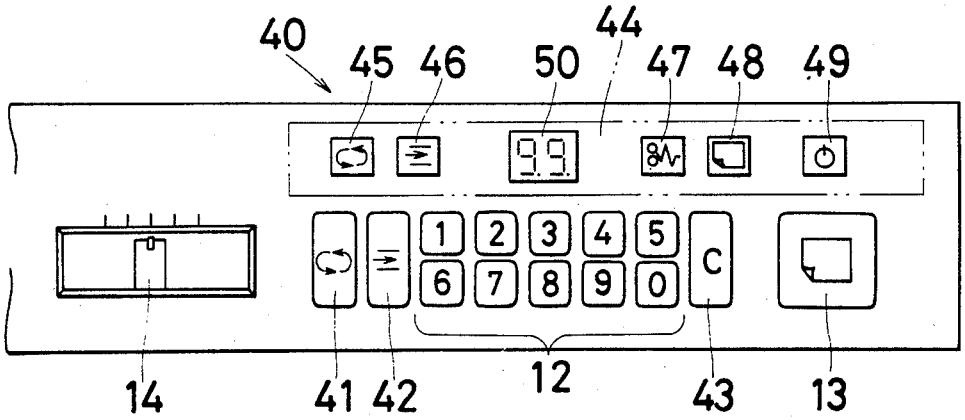
FIG. 3 is a plan view in the vicinity of a display portion shown in FIG. 1.

Referring also to FIG. 3, an operating portion 40 is provided at an upper front portion of the housing 1. The operating portion 40 has a power switch 11, a knob for controlling exposure 14, a ten key pad 12, a print button 13, a memory key 41, a intrusion key 42, a clear key 43 and a display panel 44. The density of the toner image formed on a copy paper sheet 8 may be controlled by sliding the knob 14. The ten key pad 12 is used for presetting the number of copy paper sheets to be copied, and numbers 0 to 9 are displayed on the surface of the keys of ten key pad 12. The print button 13 is pushed when the copying operation of the copying apparatus should be started. The memory key 41 is used when each of a plurality of original documents should have the same number of copies, and is pushed in order to store the preset number until the copying operation is completed. The intrusion key 42 is pushed when the copying operation of another original document intrudes into an ordinary multiple copying operation. The clear key 43 is pushed to cancel the number to be copied which has been preset by the ten key pad 12.

The display panel 44 comprises a plurality of display lamps 45 to 49 having symbols on their surfaces and a display station 50 having seven segments. When the memory key 41 is pushed, the display lamp 45 turns on to indicate that the memory key 41 was pushed. When the intrusion key 42 is pushed, the display lamp 46 turns on to indicate that the intrusion key 42 was pushed. When the memory key 41 is pushed twice, the memory function is cancelled, also, when the intrusion key 42 is pushed twice, the intrusion function is cancelled. The display station 50 turns on when the ten key pad 12 is pushed, and displays the preset number to be copied, for example, by displaying a number having two figures. The display lamp 47 for displaying a copy paper jam turns on when a copy paper jam is detected by the detecting switch 36. The display lamp 48 turns on when the detecting switch 34 detects that the copy paper sheets 8 in the cassette 9 have been completely consumed, and turns on and off so that its on-period is shorter than its off-period when the toner amount detecting device 39 detects that the toner in the developing device 24 has been consumed beyond the predetermined level, and turns on and off so that its on-period is longer than its off-period when the detecting switch 33 detects that the exposure lamp 16 is overheated. Thus, the display lamp 48 displays the above-mentioned three conditions. The display lamp 49 for displaying the condition that the copying apparatus is suitable for fixing turns on when the power switch is pushed, and turns off to indicate the condition that the copying apparatus is operable when the thermo-detector 37 detects that the heat fixing device 27 has reached the predetermined temperature for heat fixing.

The control circuit 38 is provided in the housing 1 relating to the operating portion 40. The control circuit 38 controls the movements of the original document table 2, the photosensitive drum 22, the feeding roller 25 for transporting the copy paper sheets 8 and the other feeding rollers in response to the operation of the power switch 11, the ten key pad 12, the print button 13, the memory key 41, the intrusion key 42, and the clear key 43. The control circuit 38 also has an ability to detect the blowing of a fuse which is provided to protect a transformer for generating a high voltage used for the charging devices 23 and 26, and a motor for driving the original document table 2 and the photosensitive drum 22. Furthermore, in response to an output from the detecting switches 33–36, the thermo-detector 37 and the toner amount detecting device 39, the control circuit 38 displays their output conditions, namely, the operating condition of the copying apparatus is displayed on the display panel 44 of the operating portion 40.

Figure 4:
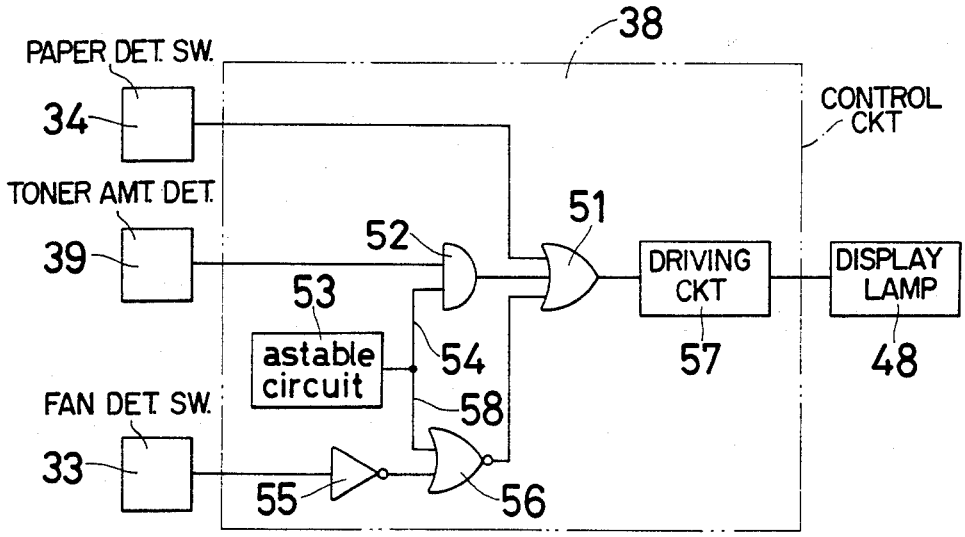
FIG. 4 is a partly block diagram of a control circuit of a display lamp.
Figure 5:
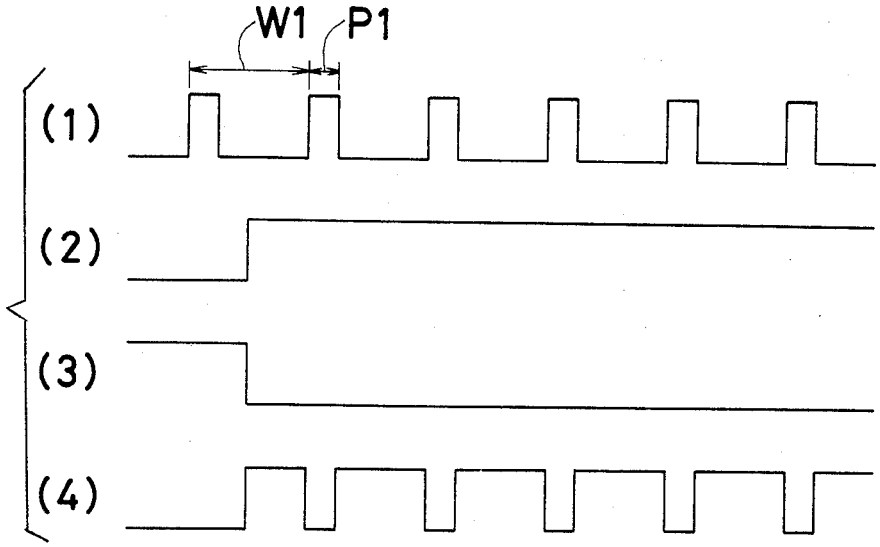
FIG. 5 is a wave diagram for depicting the operation of the control circuit.

FIG. 4 is a partial block diagram of a control circuit 38 relating to a display lamp 48, and FIG. 5 is a wave diagram for depicting the operation thereof. An output from the detecting switch 34 is fed to an OR gate 51. An output from the toner amount detecting device 39 is fed to one input of an AND gate 52. An asymmetric rectangular signal is fed to another input of the AND gate 52, the signal being shown in FIG. 5 (1) from an astable circuit 53 via a line 54. The period of the signal W1 is selected to be about 2 seconds, and the pulse width P1 is selected to be about 0.5 seconds. The output from the AND gate 52 is fed to the OR gate 51. An output from the detecting switch 33 is fed to an input of a NOR gate 56 via an inversion gate 55. The asymmetric rectangular signal 53 is fed to another input of the NOR gate 56 from the astable circuit 53 via the branch line 58 of the line 54. An output from the NOR gate 56 is fed to the OR gate 51. The output from the OR gate 51 is fed to a driving circuit 57, and while the output signal from the OR gate 51 is at a high level, the driving circuit 57 turns the display lamp 48 on.

The detecting switch 34 provides a high level signal, as shown in FIG. 5 (2), to the OR gate 51 when the copy paper sheets 8 in the cassette 9 have been completely consumed. Under this condition, since the output signal from the OR gate 51 is also high, as shown in FIG. 5 (2), the driving circuit 57 keeps the display lamp 48 on. When the copy paper sheets 8 are provided in the cassette 9, the signal from the detecting switch 34 to the OR gate 51 turns off so as to provide a low level and the driving circuit 57 then turns the display lamp 48 off.

The toner amount detecting device 39 provides a high level signal as shown in FIG. 5 (2) which is fed to an input of the AND gate 52 when the toner has been consumed beyond the predetermined level. In response to this signal, the AND gate 52 provides a signal having the wave-form, as shown in FIG. 5 (1), corresponding to that that from the astable circuit 53; the signal is fed to the driving circuit 57 via the OR gate 51. Under this condition, the display lamp 48 turns on and off so that the on-period persists for 0.5 seconds and the off-period persists for 1.5 seconds. When the toner is supplied in the developing device 24, the signal fed from the toner amount detecting device 39 to the AND gate 52 becomes a low leve, and the signal fed from the AND gate 52 to the OR gate 51 also becomes a low level, and therefore, the driving circuit 57 turns the display lamp 48 off.

The detecting switch 33 provides a high level signal, as shown in FIG. 5 (2), which is fed to the inversion gate 55 when the fan for cooling the exposure lamp 16 fails and stops. The inversion gate 55 provides a low level signal as shown in FIG. 5 (3) to an input of NOR gate 56. Accordingly, the NOR gate 56 fed a signal as shown in FIG. 5 (4) to the driving circuit 57 via the OR gate 51. Therefore, the display lamp 48 turns on and off so that the on-period persists for 1.5 seconds, and the off-period persists for 0.5 seconds. When the fan for cooling the exposure lamp 16 is repaired so as to operate normally, the signal fed from the detecting switch 33 to the inversion gate 55 becomes a low leve. The signal from the NOR gate 56 to the OR gate 51 also becomes a low level, and the driving circuit 57 turns the display lamp 48 off. In addition, the control circuit 38 is capable of cutting off the electrical energization of the exposure lamp 16 when the signal from the detecting switch 33 becomes a high level.

In the embodiment mentioned above, when at least two of the detecting switches 33 and 34 and the toner amount detecting device 39 provide high level signals at the same time, the display lamp 48 is kept on. In this case, it is advisable to first check the object detected by detecting switch 34, namely, to check if there are copy paper sheets 8 in the cassette 9. Accordingly, several operating states of the copying apparatus can be displayed by a single display lamp 48.

Figure 6:
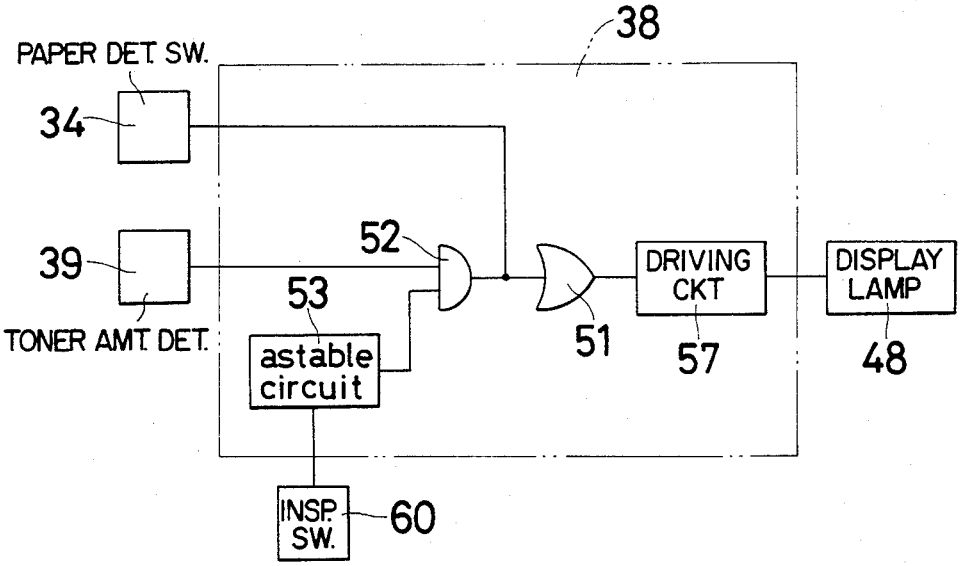
FIG. 6 is a block diagram according to another aspect of the invention.
Figure 7:
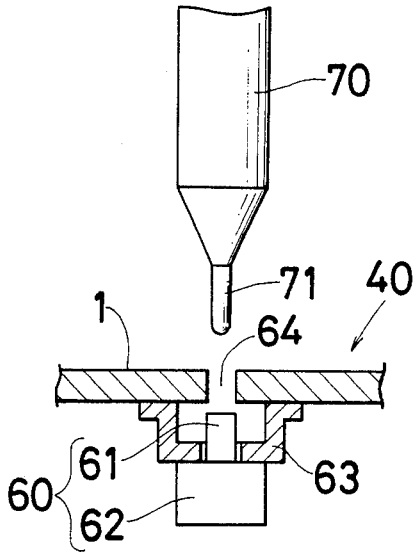
FIG. 7 is a sectional detail view of a toner amount detecting switch shown in FIG. 6.

FIG. 6 is a block diagram according to another aspect of the invention, and FIG. 7 is a detailed sectional view of detecting switch 60 which is shown in FIG. 6. In FIG. 5, a part correspond to those of FIG. 4 are provided with the same number. The novelty of the embodiment is that there are two operating states of the copying apparatus which are displayed by the display lamp 48. Namely, in this case, the display lamp 48 turns on when the detecting switch 34 detects that the copy paper sheets 8 in the cassette 9 have been completely consumed, and turns on and off when the toner amount detecting device 39 detects that the amount of toner in the developing device 24 has been consumed beyond the predetermined level. Also, relating to the toner amount detecting device 39, the astable circuit 53 is provided with a detecting or inspection switch 60. The astable circuit 53 is energized so as to operate only when the detecting switch 60 is closed. The detecting switch 60 is incorporated for example, in the operating portion 40, and comprises a button 61 and a main body 62. The detecting switch 60 is closed when the button 61 is pushed, and is opened when the button 61 is released from the pushing force. The detecting switch 60 is fixed to a portion inside the housing via a secure means 63, and a hole 64 is formed in the housing 1 at the position corresponding to the button 61. The detecting switch 60 is closed when the button 61 is pushed by a pen point of a ballpoint pen, for example, through the hole 64.

According to the embodiment, the display lamp 48 only indicates whether the copy paper sheets 8 are in the cassette 9 or when the copying apparatus is not in its normal state, namely, when the detecting switch 60 is open. In addition, the display lamp 48 indicates that there is a shortage of toner in the developing device 24 when the detecting switch 60 is closed when the copying apparatus is inspected. Thus, according to the usual embodiment, it is possible to selectively display the operating condition of a copying apparatus or to display occasional operating condition thereof.

As a further aspect of the invention, the display lamp 48 may be replaced by other display lamps 45, 46, 47 and 49. Also, other operating conditions may be indicated by a single of display lamp 48.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A display device for a copying apparatus comprising:

first and second and third detecting means for detecting a plurality of operating conditions of said apparatus, each of said detecting means generating a high level output signal corresponding to a first predetermined operating condition and a low level signal corresponding to a second predetermined operating condition;

a display element for indicating said operating conditions detected by said first and second and third detecting means;

an astable multivibrator means for generating an output signal comprising a train of pulses whose ON period is unequal to its OFF period;

an AND gate means operatively connected to said second detector means and said astable multivibrator means;

an inverter means operatively connected to said third detector means for providing an output which is inverted with respect to said output of said third detecting means;

a NOR gate means operatively connected to said astable multivibrator means and said inverter means;

an OR gate means operatively connected to said first detecting means and said AND gate means and said NOR gate means;

a driving circuit means operatively connected between an output of said OR gate means and said display means for driving said display means in response to an output from said OR gate means;

wherein said display means indicates said operating condition detected by said first and second and third detecting means by respectively providing a steady light output and a blinking light output of a first duty cycle and a blinking light output of a second duty cycle, said first and second duty cycles corresponding to a duty cycle of said output of said astable multivibrator means and a duty cycle of an inverted output of said output of said astable multivibrator means.

2. A display device as recited in claim 1, further comprising a switching means operatively connected to astable multivibrator means for either enabling or disabling said output thereof.

* * * * *